United States Patent [19]

Martin

[11] Patent Number: 4,733,431

[45] Date of Patent: Mar. 29, 1988

[54] VACUUM CLEANER WITH PERFORMANCE MONITORING SYSTEM

[75] Inventor: William J. Martin, Watervliet, Mich.

[73] Assignee: Whirlpool Corporation, Benton Harbor, Mich.

[21] Appl. No.: 939,756

[22] Filed: Dec. 9, 1986

[51] Int. Cl.[4] ..... A47L 9/19

[52] U.S. Cl. ..... 15/339; 55/274; 116/268

[58] Field of Search ..... 15/339, 347, 319; 55/174; 116/268

[56] References Cited

U.S. PATENT DOCUMENTS

| | | | |
|---|---|---|---|
| 3,177,635 | 4/1965 | Cawl et al. | 15/339 XR |
| 4,020,525 | 5/1977 | Fromknecht et al. | 15/339 |
| 4,199,838 | 4/1980 | Simonsson | 15/339 |

*Primary Examiner*—Chris K. Moore

*Attorney, Agent, or Firm*—Mason, Kolehmainen, Rathburn & Wyss

[57] ABSTRACT

A canister type vacuum cleaner includes a floor cleaning unit and a canister unit interconnected by a wand and hose assembly. The canister unit has a dust collection bag mounted in a dust collecting compartment by a dust bag mount. A suction fan evacuates the air within the dust collecting compartment causing dirt laden air to flow from the floor cleaning unit through the wand and hose assembly and into the dust bag through an intake port formed in the dust bag mount. The air is exhausted from the canister unit through a discharge port. A performance monitoring and indicating system provides information as to the operative condition of the vacuum cleaner by means of an "OK" light, a "No Bag" light, a "Check Bag" light and a "Check Hose" light. A dust bag sensor senses the differential pressure between the intake port and the dust collecting compartment and is actuated when a functional dust bag is properly mounted on the dust bag mount. A discharge sensor senses the differential pressure between the discharge port and the dust collecting compartment and an intake sensor senses the differential pressure between the outside of the vacuum cleaner and the intake port. The actuation of the intake and discharge sensors provide information to indicate when the dust bag has become too clogged or that a restriction exists in the wand and hose assembly.

36 Claims, 6 Drawing Figures

OK
NO BAG
CHECK BAG
CHECK HOSE
HIGH SPEED
LOW SPEED
POWER ON/OFF
20
22
24
26
28
30
32
34
36
38
40
42
44
46
48
50
52
54
56
60
62
64
66
68
70
72
74
76
78
80
84
88
90
92
94
96
102
138
42A
44A
46A
48A
42B
44B
46B
48B

VACUUM CLEANER WITH PERFORMANCE MONITORING SYSTEM

BACKGROUND OF THE INVENTION

A. Field of the Invention

The present invention generally relates to vacuum cleaners and, more particularly, to a new and improved vacuum cleaner with a performance monitoring and indicating system to provide an indication of operating conditions of the vacuum cleaner including whether a dust collecting bag is disposed in the vacuum cleaner and the condition of the dust collecting bag and of a wand and hose assembly.

B. Description of the Prior Art

One type of vacuum cleaner is a canister type vacuum cleaner which has a wand and hose assembly extending between a canister unit and a floor cleaning unit. One end section of the wand and hose assembly is a flexible hose which is coupled to the canister unit and the other end section is a rigid, hollow tube or wand which is coupled to the floor cleaning unit. The canister has a motor operated fan for developing suction in a dust collecting compartment. A dust bag mounted in the dust collecting compartment is adapted to be connected to a suction hose connector forming one end of the flexible hose such that when the vacuum cleaner is turned on, the suction developed in the dust collecting compartment causes air to flow into the dust bag via the floor cleaning unit, the rigid wand and the flexible hose.

The air flowing into the dust bag causes a receptacle portion of the dust bag to expand. The receptacle portion of the dust bag normally is made of porous paper. Consequently, the air flowing through the porous paper exhausts through a discharge outlet in the canister unit.

In order for the vacuum cleaner to work properly and efficiently, the dust bag must be properly mounted in the dust collecting compartment and must not become too clogged. In addition, the air passages within the wand and hose assembly must not become restricted. Because the dust bag is typically enclosed in the dust collecting compartment, an operator of the vacuum cleaner cannot readily determine whether a dust bag is mounted in the dust collecting compartment or whether the dust bag has become too clogged. Moreover, visual observation of the dust bag may not indicate whether the dust bag is clogged. In certain instances, fine dust particles or powder may coat the inner walls of the dust bag and thereby restrict the pores of the dust bag even though the quantity of debris accumulated in the dust bag does not fill the dust bag.

The volume of air flowing through the wand and hose assembly also may be lessened by a restriction in the rigid wand or in the flexible hose; however, an operator of the vacuum cleaner may have to disassemble the wand and hose assembly before determining whether such a problem has developed. Consequently, it is desirable for an operator of the vacuum cleaner to be able readily to determine whether a decrease in the performance of the vacuum cleaner is due to a restriction in the wand and hose assembly or due to a clogged bag.

A number of different condition or performance monitoring and indicating systems have been disclosed in the prior art. In certain prior art patents, a sensor usually in the form of a diaphragm switch is used to monitor the differential pressure between a point at or adjacent to an intake port of the vacuum cleaner and the atmosphere to provide an indication when the dust bag is too clogged for the vacuum cleaner to operate efficiently. Examples of such patents are U.S. Pat. Nos. 4,294,595 (Bowerman); 4,481,692 (Kurz); 3,172,743 (Kowalewski); 2,320,368 (Leathers) and 2,203,171 (Martinet). In other systems, the relative pressure of the suction chamber or dust collecting compartment is monitored in order to provide a warning that the dust bag has become clogged. For instance, U.S. Pat. Nos. 4,330,900 (Dorr et al); 4,199,838 (Simonsson); 4,193,292 (Simonsson); 4,124,916 (Fromknecht); and 3,381,652 (Schaefer et al) disclose such systems. Still other patents disclose systems for indicating when the dust bag has become clogged by sensing the amount of air flowing through the vacuum cleaner. These patents include U.S. Pat. Nos. 4,342,133 (Minton) and 3,452,385 (Fleck et al). In U.S. Pat. No. 4,070,170 (Leinfelt), the differential pressure between the inside of the dust bag and the bag chamber is used to determine the extent to which the dust bag has become clogged.

Other patents disclose plunger or lever actuated switches controlled by the bag to indicate the amount of debris which has accumulated in the bag or to indicate that a dust bag is not present in the vacuum cleaner. These patents include U.S. Pat. Nos. 3,172,743 (Kowalewski) and 2,300,705 (Schott).

SUMMARY OF THE INVENTION

An object of the present invention is to provide a new and improved vacuum cleaner that has a condition monitoring and indicating system for supplying information concerning whether a dust bag is positioned in the vacuum cleaner and whether the dust bag has become clogged or a wand and hose assembly has become restricted.

Another object of the present invention is to provide a new and improved performance or condition monitoring and indicating system for a vacuum cleaner that includes sensors for monitoring the differential pressure between (1) an intake port and the dust collecting compartment, (2) the outside of the vacuum cleaner (atmosphere) and the intake port and (3) the discharge from the vacuum cleaner and the dust collecting compartment.

Still another object of the present invention is to provide a new and improved vacuum cleaner performance or condition monitoring and indicating system which supplies distinctive signals to the operator of the vacuum cleaner to indicate either that the vacuum cleaner is operating properly or that no dust bag is mounted in the vacuum cleaner or that the dust bag has become clogged or that the wand and hose assembly has become restricted.

A still further object of the present invention is to provide a new and improved vacuum cleaner having a dust bag mount through which extends an air passage so that sensors forming a part of a performance or condition monitoring and indicating system can monitor the relative pressure at the intake port when the vacuum cleaner is being operated.

In accordance with these and many other objects, an embodiment of the present invention includes a canister vacuum cleaner having a floor cleaning unit and a canister unit interconnected by a wand and hose assembly. The canister unit has a dust collecting compartment and a motor-suction fan unit located in a motor compartment. A dust bag mount is secured in the dust collecting compartment and forms an intake port for the vacuum cleaner in the front wall of the canister unit. A dust bag made of porous material can be mounted on the dust bag mount so that the dust bag can be properly positioned in the dust collecting compartment and in communication with the wand and hose assembly. When the vacuum cleaner is turned on, the motor driven fan evacuates the air within the dust collecting compartment creating suction to cause dirt laden air to flow from the floor cleaning unit through the wand and hose assembly and into the intake port of the canister unit in which the wand and hose assembly is inserted. The dust laden air is drawn into the dust bag from the intake port and dirt and other debris are trapped in the dust bag. The filtered air flowing out through the porous material of the dust bag cools the fan motor and exits the canister unit through a discharge outlet.

The vacuum cleaner has an operating performance or condition monitoring and indicating system to provide the operator of the vacuum cleaner with information via function lights as to the status of the dust bag and the wand and hose assembly and also to turn off the motor if an operative dust bag is not installed within the dust collecting compartment. In this regard, an illumination of an "OK" light (green in color) indicates that the vacuum cleaner is functioning properly; an illumination of a "Check Bag" light (yellow in color) indicates that the dust bag has become too clogged; an illumination of a "Check Hose" light (yellow in color) indicates that the air passage in the wand and hose assembly has become restricted; and an illumination of a "No Bag" light (red in color) indicates that an operative dust bag is not properly disposed in the canister unit. These lights are suitably located on the vacuum cleaner, for example, on a display panel on a wand handle interconnecting the wand and the hose.

In order to determine the conditions represented by the function lights, the vacuum cleaner is provided with (1) a dust bag differential pressure sensor to sense the differential pressure between the intake port and the dust collecting compartment, (2) a discharge pressure differential sensor to sense the differential pressure between the exhaust air from the motor-suction fan unit and the dust collecting compartment and (3) an intake differential pressure sensor to sense the differential pressure between the outside of the vacuum cleaner (atmosphere) and the intake port. The dust bag sensor is used to determine whether an operative dust bag is in place in the dust collecting compartment when the vacuum cleaner is initially turned on, whereas the intake and discharge sensors are used to determine when the dust bag has become too clogged or a restriction has occurred in the wand and hose assembly.

A relay control circuit may be utilized to process the signals from the sensors, to activate appropriate indicator lights and to turn off the vacuum cleaner motor in response to the sensing of certain operating conditions. In the alternative, a microprocessor can be utilized to perform these functions.

Because the pressure at the intake port of the dust bag mount must be sensed by both the intake sensor and the dust bag sensor, the dust bag mount includes an air passage extending from an inlet opening at the air intake port to an outlet port. The dust bag mount is configured with a shroud over the inlet port to ensure that dust laden air is not transmitted to the intake and dust bag sensors.

BRIEF DESCRIPTION OF THE DRAWING

Many other objects and advantages and novel features of the present invention will become apparent from the following detailed description of a preferred embodiment of the present invention considered in conjunction with the drawing in which.

DESCRIPTION OF THE PREFERRED EMBODIMENT

Figures 1, 2, 3:
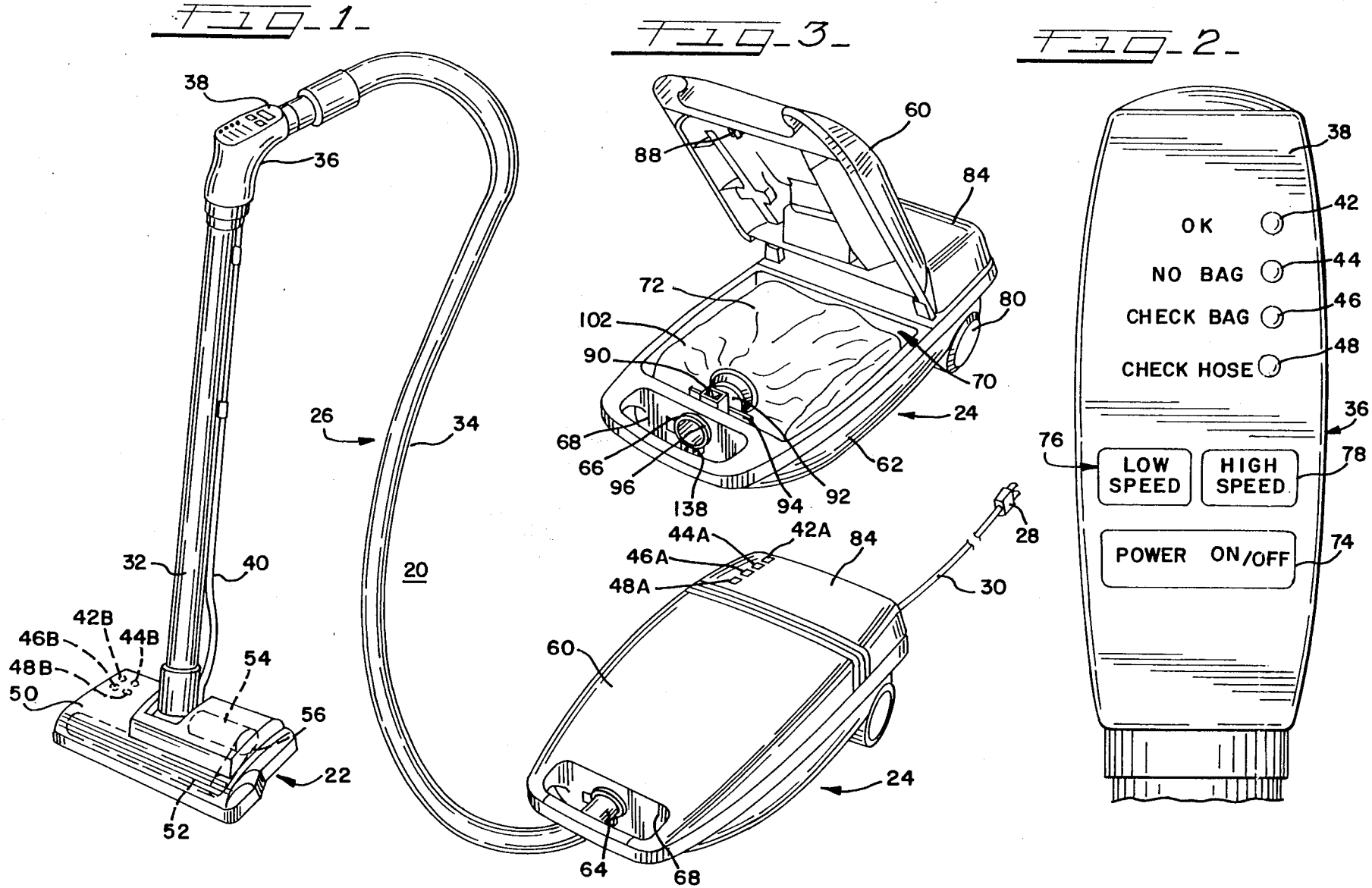
FIG. 1 is a perspective view of a vacuum cleaner constructed in accordance with the principles of the present invention.
FIG. 2 of a plan view of a wand handle control and display panel of the vacuum cleaner of FIG. 1.
FIG. 3 is a perspective view of the canister unit of the vacuum cleaner of FIG. 1 with the hood of the canister unit in its open position.

Referring more specifically to FIG. 1 of the drawing, therein is disclosed a new and improved canister vacuum cleaner 20 having a power nozzle floor cleaning unit 22 and a canister unit 24. The floor cleaning unit 22 and the canister unit 24 are mechanically, pneumatically and electrically interconnected by a wand and hose assembly 26. The vacuum cleaner 20 is powered by conventional, 110–120 volts alternating current power which is supplied to the canister unit 24 through an electrical plug 28 and a cord 30 retractably mounted to the canister unit 24.

The wand and hose assembly 26 includes a rigid wand 32 connected to a flexible hose 34 by a wand handle 36. The wand handle 36 (FIG. 2) includes a plurality of electrical controls and displays on a display panel 38. In order to supply the necessary electrical power and information to and from the wand handle 36, the flexible hose 34 has a plurality of electrical conductors (not illustrated) disposed therein and a power cord 40 is externally secured to the wand 32. The display panel 38 provides information to the operator of the vacuum cleaner 20 as to the operative status of various portions of the vacuum cleaner 20. This information may be provided by a plurality of sensorially perceptible, preferably visually perceptible, annunciators 42, 44, 46 and 48. Specifically, an "OK" light 42, a "No Bag" light 44, a "Check Bag" light 46 and a "Check Hose" light 48 are positioned on the display panel 38 of the wand handle 36. Alternatively, the lights 42, 44, 46 and 48 may be located on the canister unit 24 (as illustrated by an "OK" light 42A, a "No Bag" light 44A, a "Check Bag" light 46A and a "Check Hose" light 48A shown in dotted lines in FIG. 1) or may be located on the top of the floor cleaning unit 22 (as illustrated by an "OK" light 42B, a "No Bag" light 44B, a "Check Bag" light 46B and a "Check Hose" light 48B shown in dotted lines in FIG. 1). Reference herein to the lights 42, 44, 46 and 48 should be understood to include a reference to the alternatively disposed lights 42A, 44A, 46A and 48A or to the alternatively disposed lights 42B, 44B, 46B and 48B.

While various different colors may be selected for the lights 42, 44, 46 and 48, it is preferable that the "OK" light 42 be green in color, the "Check Bag" light 46 and the "Check Hose" light 48 be yellow in color and the "No Bag" light 44 be red in color. This scheme of colors for the lights 42, 44, 46 and 48 enables an operator of the vacuum cleaner 20 to quickly determine the performance level of the vacuum cleaner 20. For example, by having the "OK" light 42 green, an operator knows that all systems in the vacuum cleaner 20 are functioning properly. The yellow coloring for the "Check Bag" light 46 and the "Check Hose" light 48 acts as a caution warning light that the performance of the vacuum cleaner 20 has been degraded, but continued operation of the vacuum cleaner 20 will not damage the vacuum cleaner 20. On the other hand, the red coloring for the "No Bag" light 44 acts as a stop light to indicate that a serious malfunction has been detected and the vacuum cleaner 20 could be damaged if the vacuum cleaner 20 is operated.

Figure 4:
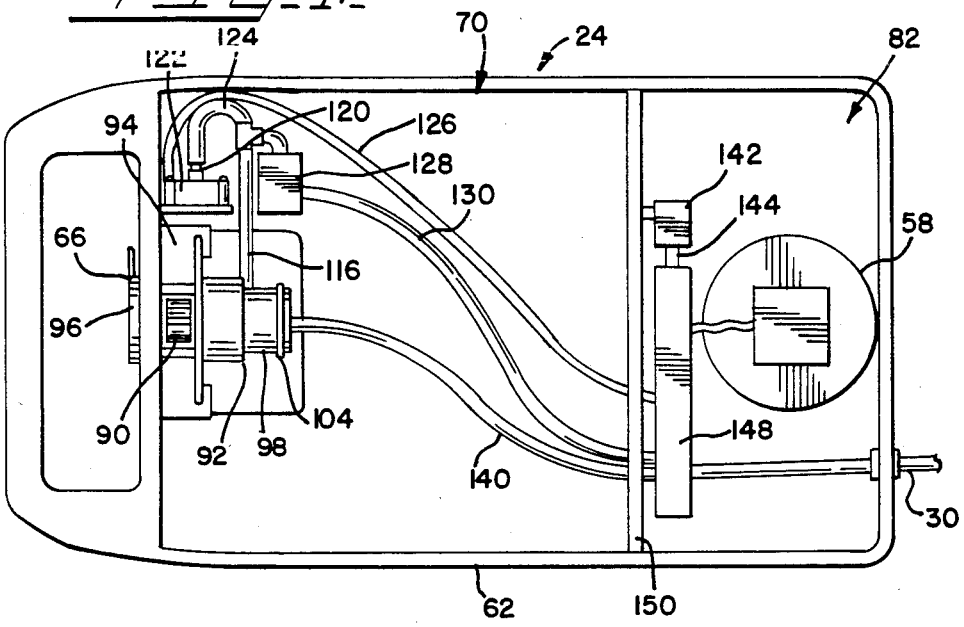
FIG. 4 is a top view of the canister unit of the vacuum cleaner of FIG. 1 with the top portion of the canister unit removed.

The floor cleaning unit 22 (FIG. 1) includes an outer housing 50 in which is disposed a rotatable brush or agitator 52. The rotatable brush 52 is driven by an electrical, alternating current brush motor 54 through a conventional belt drive assembly 56. The alternating current power for the brush motor 54 is supplied through the cord 40. The canister unit 24 includes a motor-suction fan unit 58 (FIG. 4) having a conventional suction fan driven by an electric motor. The canister unit 24 has a hood 60 which is pivotally mounted to a base 62 of the canister unit 24. A suction hose connector 64 at one end of the flexible hose 34 may be inserted into an intake opening 66 in the lower front wall 68 so that the hose 34 can be pneumatically connected to a dust collecting compartment 70 in the canister unit 24.

When the motor-suction fan unit 58 is energized, the suction thereby created causes a reduction in the pressure in the dust collecting compartment 70. As a result, air is drawn through the floor cleaning unit 22 and through the wand 32, the wand handle 36, the hose 34 and the connector 64 into a dust bag 72 disposed in the dust collecting compartment 70.

The operation of the motor-suction fan unit 58 may be controlled from the display panel 38. A switch 74 labeled "POWER ON/OFF" enables an operator to energize both the unit 58 and the brush motor 54. A touch actuated switch 76 located adjacent the switch 74 permits the operator of the vacuum cleaner 20 to set the unit 58 to operate at a low speed; and a touch actuated switch 78 adjacent to the switch 76 permits the operator of the vacuum cleaner 20 to set the unit 58 to operate at a higher speed. By controlling the speed of the unit 58, the amount of suction can be varied.

Additional controls can be provided on the display panel 38 for controlling the operation of and for obtaining information concerning the vacuum cleaner 20 and particularly the floor cleaning unit 22. Such additional controls are described in copending and commonly assigned U.S. patent application Ser. No. 815,384, filed on Dec. 31, 1985, now U.S. Pat. No. 4,654,924, issued Apr. 7, 1987, which application is hereby incorporated herein by reference.

In order to facilitate the movement of the canister unit 24, a plurality of wheels 80 are secured to the underside of the base 62 that houses the dust collecting compartment 70 and a motor compartment 82. A cover 84 encloses the motor compartment 82; and the hood 60 is pivotally mounted to the base 62 so that it can be selectively placed in a closed position (FIG. 1) or in an open position (FIG. 3). The hood 60 is maintained in its closed position by a latch 88 that engages a latch mechanism 90 at the front of the base 62. When the hood 60 is open, the dust bag 72 may be mounted on a dust bag mount 92 in the dust collecting compartment 70 (FIG. 3).

The dust bag mount 92 is made of molded plastic and is secured to the front wall 68 of the canister unit 24 by a dust bag mount bracket 94. The dust bag mount bracket 94 positions the dust bag mount 92 so that an intake port 96 formed by a tube 98 is in alignment with the intake opening 66 in the front wall 68 of the canister unit 28. In order to mount the dust bag 72 on the dust bag mount 92, a collar 100 is provided on a receptacle portion 102 of the dust bag 72, the receptacle portion 102 typically being made of a porous paper. The collar 100 is maintained positioned on the tube portion 98 by a lip 104 extending about the outer periphery of the tube 98. When the collar 100 is so positioned, the intake port 96 is in communication with and at the same pressure as the internal portion of the receptacle portion 102 of the dust bag 72.

The dust bag mount 92 has an air passage 106 extending through a wall portion 108 of the dust bag mount 92. The air passage 106 has an outlet port 110 at the outer surface of the wall 108. A gasket or seal 112 is attached about the outlet port 110 and has an opening 114 in alignment with the outlet port 110. A pressure connector 116 extends from the seal 112 and has a passage 118 which is in communication with the outlet port 110 through the opening 114. An input port 120 of a dust bag pressure sensor 122 mounted adjacent the dust bag mount bracket 94 in the dust collecting compartment 70 is coupled to the intake port 96 via the connector 116 and a tube 124. The dust bag sensor 122 is a conventional differential pressure sensor available from several different pressure sensor or switch manufacturers. When a preselected differential pressure is sensed between the input port 120 and the dust collecting compartment 70, for example, a differential pressure equivalent to the pressure of a vertical column of water having a height of approximately 1.5 inches (hereinafter referred to as_inches of water), contacts within the sensor 122 are closed (or opened depending upon the logic desired) to provide a logic signal to a plurality of conductors 126 extending out from the sensor 122.

An intake pressure sensor 128 also is mounted adjacent the dust bag mount 92 and is connected via the pressure sensing connector 116 to the intake port 96. The intake pressure sensor 128 is of the same type as the sensor 122, but senses the differential pressure between the outside of the canister unit 24 (i.e., atmosphere) and the intake port 96. In the preferred embodiment, the sensor 128 is adjusted to respond to or be activated by a differential pressure between the outside of the canister unit 24 and the intake port 96 equivalent to approximately 50 inches of water. When actuated by such a differential pressure, a logic signal is applied to a plurality of conductors 130 extending out from the intake sensor 128.

Figure 5:
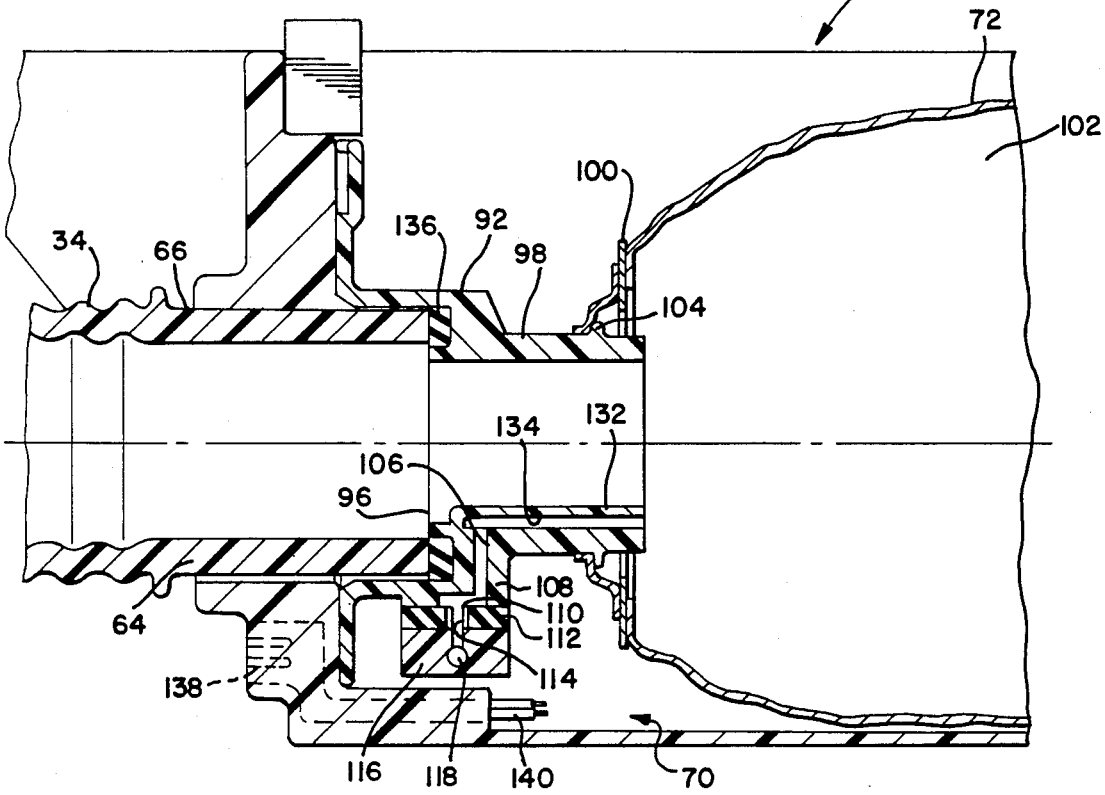
FIG. 5 is an enlarged, fragmentary, cross-sectional view of a portion of the canister unit of FIG. 4 and particularly the dust bag mount and the dust bag.

In order to prevent dust laden air from entering the passage 106 and possibly damaging the sensors 122 and 128, a shroud 132 is provided on the inside of the tube 98. The shroud 132 (FIG. 5) covers the air passage 106 such that dust laden air entering the intake port 96 from the hose connector 64 flows over the shroud 132 and into the dust bag 72 but not into the air passage 106. The shroud 132 is offset sufficiently from the curved inside wall of the tube 98 so that an air passageway 134 provides communication between the air passage 106 and the inside of the receptacle portion 102 of the dust bag 72.

A seal is attained between the intake port 96 and the wand and hose assembly 26 when the hose connector 64 is inserted into the intake opening 66 by means of a gasket 136 disposed about the outer side of the tube 98. In addition, when the hose connector 64 is so inserted into the intake opening 66, a conventional electrical power plug (not shown) mates with a connector 138 disposed adjacent the intake opening 66 so as to electrically connect a power cord 140 in the canister unit 24 to the electrical conductors in the wand and hose assembly 26.

Another pressure differential switch in the form of a discharge sensor 142 (FIG. 4) of the same type as the sensors 122 and 128 is positioned to sense the differential pressure between the discharge of the motor-suction fan unit 58 and the dust collecting compartment 70. In the preferred embodiment, the sensor 142 is adjusted to respond to or be activated by a differential pressure between the discharge of the unit 58 and the dust collecting compartment 70 equivalent to approximately 60 inches of water. When actuated by such a differential pressure, a logic signal is supplied to a plurality of conductors 144.

The sensors 122, 128 and 142 form a part of a condition monitoring and indicating circuit 146 (FIG. 6) conveniently disposed, for example, in a control panel 148 in the motor compartment 82. The circuit 148 is a relay control circuit that responds to inputs from the sensors 122, 128 and 142 and selectively actuates the "OK" light 42, the "No Bag" light 44, the "Check Bag" light 46 and/or the "Check Hose" light 48 or turns off the motor-fan unit 58. Alternatively, these functions can be performed by a microprocessor controlled circuit, in which case the microprocessor may be, for example, a Motorola 6809 microprocessor, although any one of a variety of commercially available microprocessors having conventional capabilities could be used.

The intake sensor 128 and the discharge sensor 142 generally respond to the amount of clogging occurring in the dust bag 72 or to any restriction that occurs in the air passages in the wand and hose assembly 26. For example, if the receptacle portion 102 of the dust bag 72 becomes clogged because of the amount of debris that has accumulated therein or because the pores in the wall of the receptacle portion 102 have become sufficiently blocked due to a coating of fine dust or powder, the pressure in the dust collecting compartment 70 decreases relative to the pressure at the discharge of the motor fan unit 58. Once this pressure differential between the discharge from the vacuum cleaner 20 and the dust collecting chamber 70 has increased to approximately 60 inches of water, the discharge sensor 142 is actuated and provides an input signal to the circuit 146 via the conductors 144 so that a visual indication of a clogged bag condition can be provided to the operator of the vacuum cleaner 20 by the illumination of the "Check Bag" light 46.

When a restriction occurs in the wand and hose assembly 26, the pressure at the intake port 96 decreases relative to the outside of the canister unit 24 because the motor fan unit 58 continues to attempt to evacuate air from the dust collecting compartment 70. When the pressure differential between the outside of the canister unit 24 and the intake port 96 exceeds the equivalent of approximately 50 inches of water, the intake sensor 128 is actuated. In response to a logic signal from the intake sensor 128, the "Check Hose" light 48 is illuminated to indicate to an operator that a restriction is present in the wand 32 or in the hose 34.

If a dust bag 72 is not inserted in the dust collecting compartment 70 and properly positioned on the tube 98 of the dust bag mount 92 or if the outer wall of the receptacle portion 102 of the dust bag 72 is torn, the vacuum cleaner 20 can be damaged due to the fact that dust laden air will be transmitted into the dust collecting compartment 70 and into the motor compartment 82. Such dust laden air can damage the motor-suction fan unit 58. While a filter (not shown) can be inserted in a wall 150 that separates the dust collecting compartment 70 from the motor compartment 82 to filter the air that flows from the dust collecting compartment 70 into the motor compartment 82 through access openings in the wall 150, it is preferable to have a sensor, such as the dust bag sensor 122, to detect when an operative dust bag 72 is not present or properly installed in the dust collecting compartment 70.

In order to accomplish this, the sensor 122 responds to the differential pressure between the intake port 96 and the dust collecting compartment 70. When the vacuum cleaner 20 is originally turned on in a high speed mode and if an operative dust bag 72 is disposed in the dust collecting compartment 70, a pressure differential of at least 1.5 inches of water is developed between the inside of the receptacle portion 102 of the dust bag 72 and the dust collecting compartment 70. This differential pressure is detected by the dust bag sensor 122 that provides a logic signal to the circuit 146. In the event that no operative dust bag 72 is properly disposed in the dust collecting compartment 70 when the operation of the vacuum cleaner 20 is initiated, the sensor 122 provides a signal to enable the circuit 146 to turn off the "OK" light 42, turn on the "No Bag" light 44 and turn off the motor fan unit 58.

Figure 6:
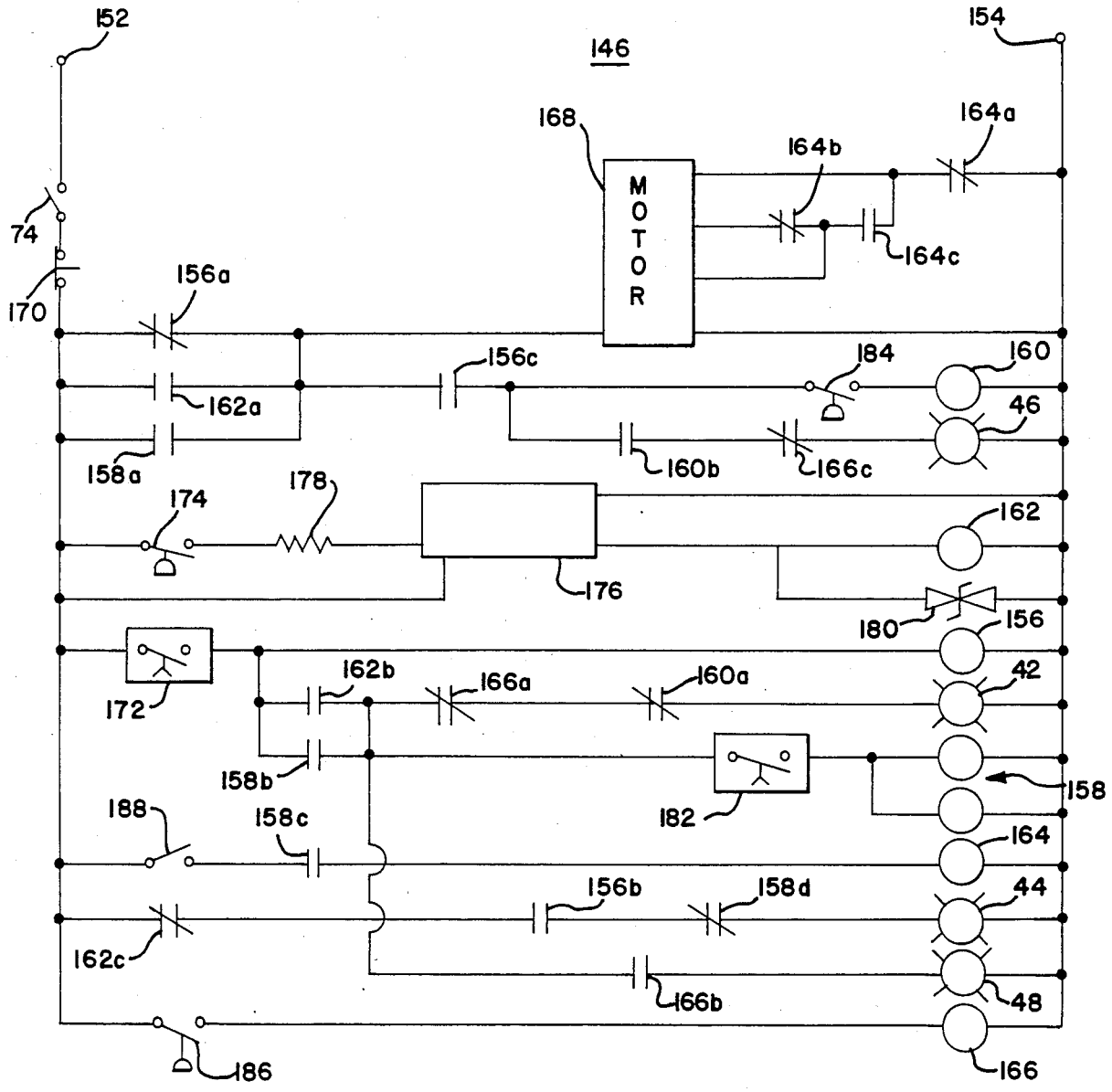
FIG. 6 is an electrical schematic of a relay control circuit for use as a part of a performance or condition monitoring and indicating system to provide information as to the operating conditions of the vacuum cleaner of FIG. 1.

The performance or condition monitoring and indicating circuit 146 for the vacuum cleaner 20 is schematically shown in FIG. 6 of the drawing. The vacuum cleaner 20 is powered by conventional, 110–120 volts alternating current power supplied to the vacuum cleaner 20 through the plug 28 and the power cord 30. The alternating current power from the power cord 30 is supplied across terminals 152 and 154. The terminal 152 is connected to the phase or line side of the cord 30 whereas the terminal 154 is connected to the neutral side of the cord 30.

The condition monitoring and indicating circuit includes six relays 156, 158, 160, 162, 164 and 166 to control the energization of the "OK" light 42, the "No Bag" light 44, the "Check Bag" light 46, the "Check Hose" light 48 and a motor 168 that forms a part of the unit 58. In the circuit 146, the switches and relay contacts are shown in their normally open or closed condition with the relays 156, 158, 160, 162, 164 and 166 not energized. The relay contacts have been labeled with the reference number of the relays 156, 158, 160, 162, 164 and 166 controlling the particular relay contacts followed by a letter designation (a through d).

When the vacuum cleaner 20 is turned on by an operator actuating the on/off switch 74 on the panel 38, the switch 74 is closed resulting in 110–120 volts alternating current power being supplied to the condition monitoring and indicating circuit 146 through a normally closed reset switch 170; and the motor 168 is energized through normally closed contacts 156*a*. The contacts 156*a* remain closed as long as the relay 156 remains deenergized as determined by a normally open time delay switch 172. The switch 172 remains open for a short start-up time delay period (for example, two to five seconds) after the closing of the switch 74. After the start-up time delay has elapsed, the switch 172 closes and the relay 156 becomes energized.

During the time delay period that the switch 172 remains open, the motor 168 is operated in its high speed mode and has an opportunity to develop a suction pressure in the dust collecting compartment 70. If an operative dust bag 72 is properly positioned in the dust collecting compartment 70, a pressure differential of at least 1.5 inches of water is developed across the dust bag pressure sensor 122 and a switch portion 174 of the sensor 122 is closed prior to the switch 172 closing following the start-up time delay. In order to ensure that the motor 168 initially is in its high speed mode, as is determined by normally closed contacts 164*a* and 164*b* and normally open contacts 164*c*, normally open contacts 158*c* are maintained open during the start-up time delay such that the relay 164 cannot be energized even if the low speed switch 76 is actuated.

When the switch 174 closes, a photo coupler 176 is energized through a resistor 178; and the relay 162 is thereby energized. The photo coupler 176 is required as the actuator for the relay 162 instead of energizing the relay 162 directly through the switch 174 because the sensor 122 must be able to respond to very low pressure differentials and the switch portion 174 of the sensor 122 cannot conduct the amount of current required to energize the relay 162. The relay 162 is protected from surges by a metal oxide varistor 180. The energization of the relay 162 closes normally open contacts 162*a* which are in parallel with the contacts 156*a* so that the motor 168 remains energized even after the contacts 156*a* open with the energization of the relay 156. When the relay 162 is energized, it is indicative of the fact that an operative dust bag 72 is in position in the dust collecting compartment 70. Accordingly, with the energization of the relay 162, normally closed contacts 162*c* are opened so that the "No Bag" light 44 will not be energized.

The "Check Bag" light 46, the "Check Hose" light 48, the "No Bag" light 44 and the "OK" light 42 all remain deenergized during the start-up time delay period. Normally open relay contacts 156*c* prevent the "Check Bag" light 46 from being illuminated; the "Check Hose" light 48 and the "OK" light 42 are not illuminated because the time delay switch 172 is in the circuit with both of the lights 48 and 42; the "No Bag" light 44 cannot be illuminated because normally open contacts 156*b* remain open.

Once the start-up time delay determined by the switch 172 has elapsed, the switch 172 closes resulting in the energization of the relay 156 which thereby causes the contacts 156*a* to open and the contacts 156*b* and 156*c* to close. In the event that the relay 162 has been energized prior to the closing of the switch 172, the normally open contacts 162*a* are closed so that the motor 168 remains energized after the contacts 156*a* open. If no other fault condition is detected, such as a clog in the dust bag 72 or a restriction in the wand and hose assembly 26, the "OK" light 42 is illuminated through the switch 172, now closed contacts 162*b* and normally closed contacts 166*a* and 160*a*.

With the closing of the time delay switch 172 and the contacts 162*b* , line potential is supplied through the switch 172 and the closed contacts 162*b* to a normally open time delay switch 182. The switch 182 remains open for a short time delay (for example, two to ten seconds). Thereafter, the pair of relays 158 are energized so that normally open contacts 158*a*, 158*b* and 158*c* are closed and normally closed contacts 158*d* are opened. While the vacuum cleaner 20 is being operated, the pressure differential across the receptacle portion 102 of the dust bag 72 may fall below 1.5 inches of water even though an operative dust bag 72 is positioned on the dust bag mount 92. In order to prevent false "No Bag" warnings and the turning off of the vacuum cleaner 20 when the relay 162 is inappropriately energized, the relays 158 are used essentially to override the effect of the energization of the relay 162 by having its contacts 158*a* in parallel with the contacts 162*a* and its contacts 158*b* in parallel with the contacts 162*b* and by opening the normally closed contacts 158*d*. Consequently, once the relays 158 are energized following the time delay set by the switch 182, the circuit 146 will not respond to the opening or closing of the switch 174.

As long as the vacuum cleaner 20 is operating properly, a switch 184 forming a part of the discharge sensor 142 and a switch 186 forming a part of the intake sensor 128 remain in their normally open condition. With the switch 186 open, the relay 166 remains deenergized and the "Check Hose" light 48 is maintained off due to normally open contacts 166*b*. Likewise, the "Check Bag" light 46 remains off because the relay 160 remains deenergized so that normally open contacts 160*b* remain open.

During this normal operation of the vacuum cleaner 20, the speed of the motor 168 can be adjusted by the high speed switch 78 and the low speed switch 76 that together control a switch 188. With the switch 188 open, the motor 168 is operated at its high speed as determined by the normally closed contacts 164*a* and 164*b* and the normally open contacts 164*c*. In order to decrease the speed of the motor 168, the switch 188 is closed in response to the actuation of the switch 76 on the panel 38, resulting in the relay 164 being energized through the closed switch 188 and the closed contacts 158*c*. The energization of the relay 164 opens the contacts 164*a* and 164*b* and closes the contacts 164*c*. The motor 168 then is in its lower speed mode and a lesser amount of suction is developed by the vacuum cleaner 20.

In the event that the dust bag 72 becomes so clogged that the discharge sensor 142 senses a differential pressure of at least approximately 60 inches of water between the discharge from the vacuum cleaner 20 and the dust collecting compartment 70, the switch 184 closes. With the switch 184 closed, the relay 160 is energized through the closed contacts 162*a* or 158*a*, the closed contacts 156*c* and the closed switch 184 resulting in the closing of the normally open contacts 160*b* and the opening of the normally closed contacts 160*a*. The opening of the contacts 160*a* deenergizes the "OK" light 42 to signify that a malfunction has been detected in the vacuum cleaner 20. In addition, the "Check Bag" light 46 is energized through the now closed contacts 160*b*, the closed contacts 162*a* or 158*a*, the closed contacts 156*c* and normally closed contacts 166*c*. The illumination of the "Check Bag" light 46 warns an operator of the vacuum cleaner 20 that the dust bag 72 should be checked because it is either too full of debris or the pores of the bag material have been so coated with fine dust or powder that a sufficient amount of air is not flowing through the dust bag 72. Once the dust bag 72 has been cleaned or replaced, the vacuum cleaner 20 can be again started by the closing of the switch 74; and the circuit 146 rechecks the condition of the vacuum cleaner 20.

If a restriction occurs in the wand and hose assembly 26 such that a differential pressure in excess of approximately 50 inches of water is detected by the intake sensor 128 between atmosphere and the inside of the dust bag 72, the switch 186 closes. In certain instances when the passage in the wand 32 or the hose 34 becomes restricted, the differential pressure between the discharge of the vacuum cleaner 20 and the dust collecting compartment 70 will increase to above 60 inches of water and the switch 184 also will close. The closing of the switch 186 results in the energization of the relay 166 and the closing of the normally open contacts **166*b*. The "Check Hose" light 48 is energized through the closed contacts 166*b*, the closed contacts 162*b* or 158*b* and the switch 172. The energization of the relay 166 also opens the contacts 166*c* so that the "Check Bag" light 46 cannot be energized even though the switch 184 has closed. Since a malfunction condition has been detected, the "OK" bag light 42 is deenergized by the opening of the contacts 166*a* in response to the energization of the relay 166**.

If no dust bag 72 is disposed on the dust bag mount 92 or if the dust bag 72 is torn when the vacuum cleaner 20 is turned on, the "No Bag" light 44 is illuminated and the motor 168 is turned off. This occurs because the differential pressure across the dust bag sensor 122 is not sufficient to close the switch 174. Consequently, when the switch 172 closes at the end of the start-up time delay, the relay 162 is not energized and the "No Bag" light 44 is illuminated through the normally closed contacts **162*c*, the closed contacts 156*b* and the normally closed contacts 158*d*. In addition, the relays 158 will not be energized and the "OK" light 42 is maintained off because the contacts 162*b* remain open. Since the contacts 162*a* and 158*a* remain open and the contacts 156*a* are now open, the motor 168 is turned off because it no longer receives power from the terminal 152**.

A reset switch 170 is provided such that if the "No Bag" light 44 is illuminated and the motor 168 is turned off, an operator of the vacuum cleaner 20 can have the circuit 146 recheck the status of the dust bag 72 by opening and then closing the switch 170. When the switch 170 is closed, the circuit 146 responds in the same manner as when the on/off switch 74 was originally closed. If the dust bag 72 is still in a non-operative condition such that the dust bag sensor 122 does not sense a differential pressure of approximately 1.5 inches of water, the pressure sensing switch 174 does not energize the relay 162 and the "No Bag" light 44 is turned on and the motor 168 is turned off. Once a dust bag 72 is installed in the dust collecting compartment 70 and the vacuum cleaner 20 is again turned on by the closing of the switch 74, the vacuum cleaner 20 can be operated in a normal manner.

Obviously, many modifications and variations of the present invention will become apparent from the above teachings. Thus, it is to be understood that, within the scope of the appended claims, the invention may be practiced otherwise than as specifically described hereinabove.

What is claimed and desired to be secured by Letters Patent is:

1. A vacuum cleaner condition indicator for use with a vacuum cleaner having a dust collecting compartment and a dust bag adapted to be disposed in said dust collecting compartment, comprising dust bag sensing means for sensing the differential pressure between the inside of said dust bag and said dust collecting compartment to provide a first signal when said dust bag is properly disposed in said dust collecting compartment, and to provide a second signal when said dust bag is not properly disposed in said dust collecting compartments, and indicating means associated with said dust bag sensing means for providing sensorially perceptible indicating signals in response to said first and second signals.

2. A condition indicator as recited in claim 1 wherein said dust bag sensing means includes a first switch means actuated in response to said differential pressure being of at least a preselected magnitude.

3. A condition indicator as recited in claim 2 wherein said preselected magnitude is a pressure equivalent to approximately 1.5 inches of water.

4. A condition indicator as recited in claim 2 wherein said indicating means includes a first indicating light, the actuation of said first switch means controlling the illumination of said first indicating light.

5. A condition indicator as recited in claim 4 wherein said indicating means includes timing means prohibiting the illumination of said first indicating light except during a preselected time interval after said vacuum cleaner is energized.

6. A condition indicator as recited in claim 4 wherein said first indicating light is red in color.

7. A condition indicator as recited in claim 1 wherein said vacuum cleaner includes an intake port in communication with the inside of said dust bag and wherein said dust bag sensing means includes pressure sensing means to sense the pressure at said intake port.

8. A vacuum cleaner dust bag mount for mounting a dust bag in a vacuum cleaner, said dust bag adapted to receive dirt laden air therein, said bag mount comprising mounting means for mounting said dust bag on said bag mount, said mounting means providing an intake air passage between the outside of said vacuum cleaner and the inside of said dust bag, pressure sensing air passage means extending through said bag mount and in communication with said intake air passage and shroud means in said intake air passage for shielding said pressure sensing air passage means so as to prevent said dirt laden air from entering said pressure sensing air passage means.

9. A dust bag mount as recited in claim 8 wherein said air intake passage includes a tubular passage and wherein said pressure sensing air passage means includes an air passage extending through a wall of said tubular passage and in communication with said tubular passage.

10. A dust bag mount as recited in claim 9 wherein said shroud means includes a generally flat shroud covering said air passage and offset from said wall of said tubular passage.

11. A dust bag mount as recited in claim 9 wherein said tubular passage extends from a first end adjacent an outside wall of said vacuum cleaner to a second end in a dust collecting compartment of said vacuum cleaner and wherein said shroud means is positioned so that said shroud means provides a communicating air passage between said air passage and the second end of said tubular passage.

12. A dust bag mount as recited in claim 11 wherein said shroud means is offset from the outside wall of said tubular passage to provide said communicating air passage, said shroud means is affixed to said tubular passage adjacent said first end so that said communicating air passage is in communication with said tubular passage only adjacent said second end.

13. A vacuum cleaner condition indicator for use with a vacuum cleaner having an intake port, a dust collecting compartment, a dust bag adapted to be disposed in said dust collecting compartment and a discharge port, comprising first sensing means sensing the differential pressure between said intake port and said dust collecting compartment to provide a first sensing signal, second sensing means sensing the differential pressure between said discharge port and said dust collecting compartment to provide a second sensing signal, third sensing means sensing the differential pressure between the outside of said vacuum cleaner and said intake port to provide a third sensing signal and indicator means associated with said first, second and third sensing means for providing sensorially perceptible indicating signals in response to said first, second and third sensing signals.

14. A condition indicator as recited in claim 13 wherein said first sensing means includes a first switch means actuated in response to the existence of a differential pressure of at least a first magnitude between said intake port and said dust collecting compartment.

15. A condition indicator as recited in claim 14 wherein said first magnitude is a pressure equivalent to approximately 1.5 inches of water.

16. A condition indicator as recited in claim 14 wherein said second sensing means includes a second switch means actuated in response to the existence of a differential pressure of at least a second magnitude between said discharge port and said dust collecting compartment.

17. A condition indicator as recited in claim 16 wherein said second magnitude is a pressure equivalent to approximately 60 inches of water.

18. A condition indicator as recited in claim 16 wherein said third sensing means includes a third switch means actuated in response to the existence of a differential pressure of at least a third magnitude between the outside of said vacuum cleaner and said intake port.

19. A condition indicator as recited in claim 18 wherein said third magnitude is a pressure equivalent to approximately 50 inches of water.

20. A condition indicator as recited in claim 18 wherein said indicator means includes an indicating light, the actuation of said first switch means controlling the illumination of said indicating light.

21. A condition indicator as recited in claim 20 wherein said indicating light is red in color.

22. A condition indicator as recited in claim 18 wherein said vacuum cleaner includes a suction producing motor unit, said indicator means controlling the energization of said suction producing motor unit in response to the actuation of said first switch means.

23. A condition indicator as recited in claim 18 wherein said indicator means includes an indicating light illuminated in response to the actuation of said second switch means.

24. A condition indicator as recited in claim 23 wherein said indicating light is yellow in color.

25. A condition indicator as recited in claim 18 wherein said indicator means includes an indicating light illuminated in response to the actuation of said third switch means.

26. A condition indicator as recited in claim 25 wherein said indicating light is yellow in color.

27. A condition indicator as recited in claim 18 wherein said indicator means includes an indicating light, the actuation of said first, second and third switch means controlling the illumination of said indicating light.

28. A condition indicator as recited in claim 27 wherein said indicating light is green in color.

29. A vacuum cleaner comprising a canister unit having an air intake, a wand and hose assembly having a first end and a second end, said first end adapted to be received in said air intake, a floor cleaning unit adapted to receive said second end, a dust collecting compartment in said canister unit, a dust bag in said dust collecting compartment in pneumatic communication with said air intake, said canister unit including an air discharge and suction means, said suction means adapted to cause air to flow from said wand and hose assembly into said canister unit through said air intake, through said dust bag and out of said canister unit through said air discharge, and an operating condition indicating system including first pressure actuated switch means responsive to the existence of a first differential pressure between said air intake and said dust collecting compartment of at least a first magnitude for providing a first sensing signal, second pressure actuated switch means responsive to the existence of a second differential pressure in said cansiter unit for providing a second sensing signal, and signal response means for responding to said first and second sensing signals and for providing sensorially perceptible indicating signals to an operator of said vacuum cleaner.

30. A vacuum cleaner as recited in claim 29 wherein said signal response means provides a first visually perceptible signal in response to said first sensing signal and provides a second visually perceptible signal in response to said second sensing signal.

31. A vacuum cleaner as recited in claim 30 wherein said first visually perceptible signal is a light relating to the presence of said dust bag in said dust collecting compartment and said second visually perceptible signal comprises light means for indicating the condition of said dust bag and said wand and hose assembly.

32. A vacuum cleaner as recited in claim 30 wherein said first and second visually perceptible signals are lights mounted on said wand and hose assembly.

33. A vacuum cleaner as recited in claim 30 wherein said first and second visually perceptible signals are lights mounted on said canister unit.

34. A vacuum cleaner as recited in claim 30 wherein said first and second visually perceptible signals are lights mounted on said floor cleaning unit.

35. A vacuum cleaner as recited in claim 29 wherein said second pressure actuated switch means includes a discharge pressure actuated switch means responsive to the existence of a second differential pressure between said air discharge and said dust collecting compartment of at least a second magnitude for providing a check bag signal and an intake pressure actuated switch means responsive to the existence of a third differential pressure between the outside of said canister unit and said air intake of at least a third magnitude for providing a check hose signal.

36. A vacuum cleaner as recited in claim 35 wherein said signal response means illuminates a first light in response to said check hose signal and illuminates a second light in response both to the presence of said check bag signal and the absence of said check hose signal.

* * * * *